US006334432B1

(12) United States Patent
Ferraro et al.

(10) Patent No.: US 6,334,432 B1
(45) Date of Patent: Jan. 1, 2002

(54) HOLDER BODY FOR A FUEL INJECTION VALVE FOR INTERNAL COMBUSTION ENGINES

(75) Inventors: Giovanni Ferraro, Ludwigsburg; Hansjoerg Egeler, Fellbach; Andreas Wengert, Oppenweiler, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,722

(22) PCT Filed: Jun. 24, 1999

(86) PCT No.: PCT/DE99/01836

§ 371 Date: Aug. 25, 2000

§ 102(e) Date: Aug. 25, 2000

(87) PCT Pub. No.: WO00/26529

PCT Pub. Date: May 11, 2000

(30) Foreign Application Priority Data

Nov. 2, 1998 (DE) ..... 198 50 390

(51) Int. Cl.[7] ..... F02M 37/04
(52) U.S. Cl. ..... 123/468; 123/470
(58) Field of Search ..... 123/468, 469, 123/470

(56) References Cited

U.S. PATENT DOCUMENTS

| | | | | | |
|---|---|---|---|---|---|
| 2,897,800 | A | * | 8/1959 | Haas | 123/469 |
| 4,590,911 | A | * | 5/1986 | Sciotti et al. | 123/468 |
| 5,617,828 | A | * | 4/1997 | Kuegel et al. | 123/468 |
| 5,878,719 | A | * | 3/1999 | Nakagomi | 123/470 |
| 6,119,657 | A | * | 9/2000 | Stevens et al. | 123/469 |
| 6,243,413 | B1 | * | 5/2001 | Greaney | 239/533.2 |

* cited by examiner

*Primary Examiner*—Thomas N. Moulis
(74) *Attorney, Agent, or Firm*—Ronald E. Greigg

(57) ABSTRACT

A holder body for a fuel injection valve for internal combustion engines, having a substantially cylindrical basic shape and a centrally disposed axial blind bore, originating at a first end face, as well as a flow conduit offset laterally from the blind bore, which flow conduit, entering the first end face, emerges from the holder body axially downstream of a closed end of the blind bore, at an incline to the axis of the blind bore. The outlet opening of the flow conduit is disposed on a second end face, remote from the first end face, of the holder body, and a longitudinal axis of the holder body in the region of the second end face is angled by a predetermined angle relative to a longitudinal axis of the holder body in the region of the blind bore.

16 Claims, 4 Drawing Sheets

HOLDER BODY FOR A FUEL INJECTION VALVE FOR INTERNAL COMBUSTION ENGINES

BACKGROUND OF THE INVENTION

FIELD OF THE INVENTION

The invention relates to fuel injectors, and more particularly to a holder body for a fuel injection valve for internal combustion engines.

SUMMARY OF THE INVENTION

One known holder body, disclosed in European Patent Disclosure EP 0 569 727, has a cylindrical basic shape, and a central axial blind bore is machined into its end face oriented toward the combustion chamber This blind bore, extending approximately as far as an axially middle region of the holder body, serves in the holder body of the fuel injection valve to receive a valve spring, which urges a valve member of the fuel injection valve in the closing direction. A fuel flow conduit is also provided in the holder body; it is formed of an axial blind bore originating at the end face toward the combustion chamber and a radial bore intersecting it; the radial bore emerges laterally at a cylindrical jacket face of the holder body. The bore intersection between the axial bore of the flow conduit and the preferably obliquely disposed radial bore is provided in a region axially downstream of the closed end of the blind bore that receives the valve spring. The lateral outlet opening of the flow conduit on the circumferential wall of the holder body has a conical seat face, at which a pressure tube neck comes to rest with its conical end face; this pressure tube neck is braced radially against the holder body via lock nuts. The known holder body with a lateral pressure tube connection has the disadvantage that as a consequence of the lateral bracing of the pressure tube neck against the holder body, radial forces are introduced to the holder body that impair its durability. A sharp deflection of the fuel stream also occurs at the bore intersection between the bore segments of the flow conduit, and this has a deleterious effect on the fuel flow in the flow conduit. A further disadvantage of the bore intersection of the partial bores of the flow conduit is caused by the notch effect that occurs there, which can reduce the durability of the holder body still further. Furthermore, the known holder body with a lateral pressure tube connection has the disadvantage that it is relatively complicated to produce and to install, so that its realization requires high production effort and expense.

SUMMARY OF THE INVENTION

The holder body of the invention for a fuel injection valve for internal combustion engines has the advantage over the prior art that a lateral connection of a high-pressure fuel delivery line on the holder body is possible without thereby introducing radial forces to the holder body and without an unstreamlined bore intersection inside the holder body. This is advantageously possible by kinking or angling the holder body. In this way, a laterally incoming high-pressure line can be screwed in a structurally simple way to the end of the holder body remote from the combustion chamber, and known high-pressure connection necks can be used. The fuel inflow opening in the holder body is provided in the end face of the holder body remote from the combustion chamber, and only after the through bore forming the flow conduit is made in the holder body is the holder body bent to the final amount. In this way, bore intersections that occur when an oblique bore intersects a straight bore can be avoided. A further advantage, besides the avoidance of radial fastening forces and bore intersections in the flow conduit, is the use of conventional pressure tube necks screwed onto the holder body, so that the additional fastening crossbars can be dispensed with. With the provision of the unilateral lateral recess on the circumferential face of the holder body, a greater bending angle can also be attained when the holder body is bent; this angle can be up to 90° and more. The holder body can be manufactured in a simple way, and various courses of production are possible. The holder body can initially be embodied like a known holder body, into which, after the spring chamber blind bore and the flow conduit have been made, the lateral recess is machined, and which is then angled accordingly on a bending bench. However, it is also possible to prepare a holder body blank in which the lateral recess is already provided. This blank can be produced with the recess without metal cutting, for instance by forging, rolling, stamping and the like; however, the recess can also be made by metal-cutting methods, such as milling, or on a lathe, in a cylindrical holder body blank. After that, the appropriate bores are then made in the holder body, and a partial region of the flow conduit that receives a fuel filter is advantageously made, beginning at the end face remote from the combustion chamber, in the form of an oblique bore with a slight angle of inclination to the longitudinal axis of the holder body and then in a known manner discharges into an axial longitudinal bore offset laterally from the spring chamber. In this case as well, the angling of the holder body by a predetermined angle is done as a final work step, preferably on a bending bench. The angled region of the holder body is provided in the region of the lateral cross-sectional recess on the holder body, and the holder body is always angled in the direction remote from the lateral recess. Alternatively, other production methods are possible, for instance in which the flow conduit is embodied as a straight-line through bore, to which end the holder body, in the region outside the spring chamber, is bent slightly out of the center axis of the spring chamber, so that the through bore offset from the spring chamber can discharge into the end face, remote from the combustion chamber, of the holder body. It is advantageous, at the outlet opening of the flow conduit on the end face remote from the combustion chamber, to provide a conical bore outlet; these conical faces form a bearing face for a pressure tube connection to be screwed on. A further advantageous exemplary embodiment of the production method for the holder body of the invention is attained by combining the aforementioned method steps; first, the axial central blind bore forming the spring chamber is made in the holder body from the lower end face, nearer the combustion chamber. At the same time, on the opposite end face of the holder body remote from the combustion chamber, a central blind bore can be made that in terms of its cross section is dimensioned so as to be suitable for receiving a rod filter. In a further work step, the holder body is then angled slightly in the region outside the spring chamber, so that now an axial blind bore offset laterally from the spring chamber can be made in the holder body in such a way that it discharges into the blind bore region intended for receiving the bar filter. In this case as well, the lateral machining of a recess on the circumference of the holder body and following that the bending of the holder body in the direction remote from the lateral recess are now done. Beyond the four examples of methods shown in the description, it is furthermore possible to produce the holder body of the invention by combining the various method steps known from these four examples with one another. What is essential is that the bore geometry of the flow conduit and preferably also of the spring chamber in the holder body be established before the holder body is angled into its final form.

Thus with the holder body of the invention for a fuel injection valve for internal combustion engines, it is possible to furnish a lateral high-pressure connection that in a structurally simple way overcomes the disadvantages of an induction of force radially to the holder body and of a bore intersection inside the holder body, and onto which high-pressure pressure connection the known pressure tube neck can be screwed axially onto the end remote from the combustion chamber in a simple way. This holder body for receiving laterally incoming high-pressure fuel lines can be produced in an especially simple and economical way by using the production methods described.

BRIEF DESCRIPTION OF THE DRAWINGS

Four exemplary embodiments of the holder body of the invention and of the corresponding production methods are described in further detail herein below, in conjunction with the drawings, in which.

DESCRIPTION OF THE PREFERRED EMBODIMENTS

Figures 1A, 1B, 1C, 1D, 1E:
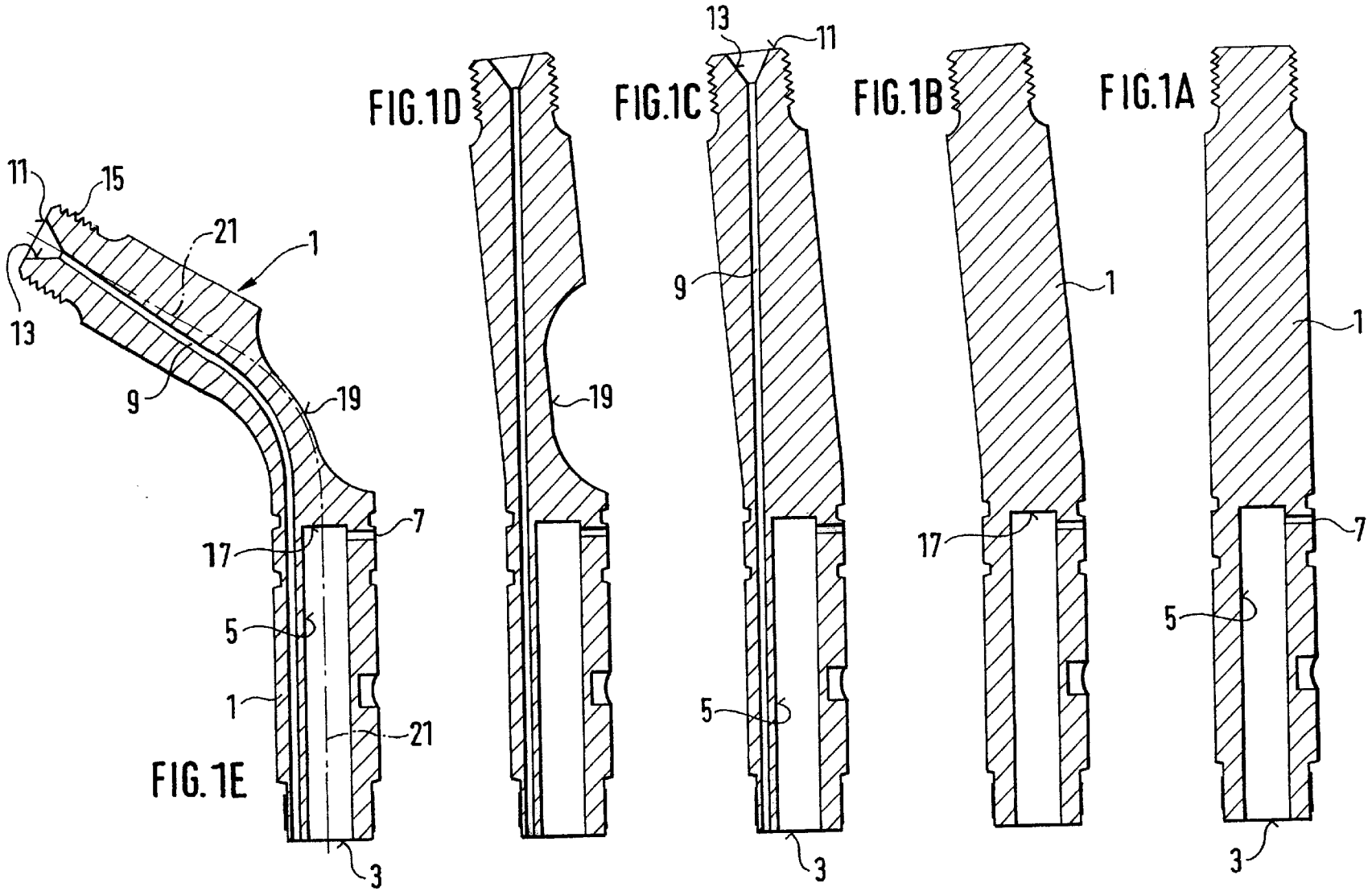
FIGS. 1A–E shows a first exemplary embodiment of the holder body in various stages of production, in which the flow conduit is embodied as a continuous bore with the same diameter.

FIG. 1 shows a first exemplary embodiment of the holder body of the invention for a fuel injection valve for internal combustion engines. The holder body 1, shown in its final embodiment in FIG. 1E, which has a cylindrical basic shape, is braced in a known manner by means of a lock nut, not shown, axially against a valve body, also not shown, in which an axially displaceable valve member is guided for controlling an injection cross section. This valve member is urged in the closing direction by a valve spring, not shown. The holder body 1 has a centrally disposed axial blind bore 5, originating at a first end face 3 toward the combustion chamber, which forms a spring chamber for receiving the valve spring of the fuel injection valve. From this blind bore 5, a radial bore 7 leads away to the cylindrical circumferential wall of the holder body 1; this bore is embodied as a relief bore 7. The holder body 1 also has a flow conduit 9, beginning at the first end face 3 and protruding through the holder body 1, which emerges from the holder body 1 at a second end face 11 thereof, remote from the combustion chamber. At its orifice into the second end face 11, the flow conduit 9 has a conical cross-sectional widening, which forms a conical bearing face 13, at which a corresponding sealing cone of a high-pressure fuel supply line, not shown, comes to rest. For securing a pressure neck, or a union nut that presses the pressure connection of the high-pressure fuel supply line against the conical face 13, a screw thread 15 is furthermore provided on the holder body 1, on its cylindrical circumferential wall face, at the level of the conical bearing face 13. Axially downstream of a closed end 17 of the blind bore 5, the holder body 1 has a unilateral lateral recess 19, which reduces the cross section of the holder body 1 in this middle region and thus forms a taper of the holder body 1. This recess 19 is always machined into the side of the holder body 1 remote from the flow conduit 9. In the region of the lateral recess 19, the holder body 1 is angled in radiuslike fashion in the direction remote from the lateral recess 19, so that the longitudinal axis 21 of the holder body 1 in the region between the second end face 11 and the lateral recess 19 is angled by a predetermined angle to the longitudinal axis 21 of the holder body 1 in the region of the blind bore 5. In this way, a laterally incoming high-pressure fuel supply line can be screwed axially onto the holder body 1 without causing radial fastening forces on the holder body 1 or creating a bore intersection with the flow conduit 9.

In conjunction with FIGS. 1A through 1E, a first production method according to the invention for the holder body 1 will now be explained. As shown in FIG. 1A, the central blind bore 5 is first made in a cylindrical holder body base body 1, beginning at the first end face 3. It is advantageous at this stage of production to make the relief bore 7 already as well.

In a further method step, shown in FIG. 1B, the holder body base body 1 is bent, with a slight angular offset, in a region axially above the closed end 17 of the blind bore 5.

Now, in a third method step shown in FIG. 1C, the flow conduit 9 is made as a through bore into the holder body 1; this bore enters the first end face 3 at a lateral offset to the blind bore 5 and emerges centrally from the holder body 1 at the second end face 11. It is advantageous for the conical stop face 13 again to be made as a countersunk feature in the through bore of the flow conduit 9.

In a further, fourth method step, as shown in FIG. 1D, the lateral recess 19 is now machined into the cylindrical jacket face of the holder body 1 remote from the flow conduit 9; this is advantageously done by metal-cutting machining.

In a further, fifth method step, shown in FIG. 1E, by suitable angling of the holder body 1, preferably on a bending bench, the final geometry of the holder body 1 is established; the holder body 1 is bent to a predetermined value in the direction remote from the lateral recess 19.

The machining of the thread 15 is advantageously already done before the first method step shown in FIG. 1A, on the holder body blank, but can alternatively also be done at some later time in the machining.

Figures 2A, 2B, 2C, 2D, 2E:
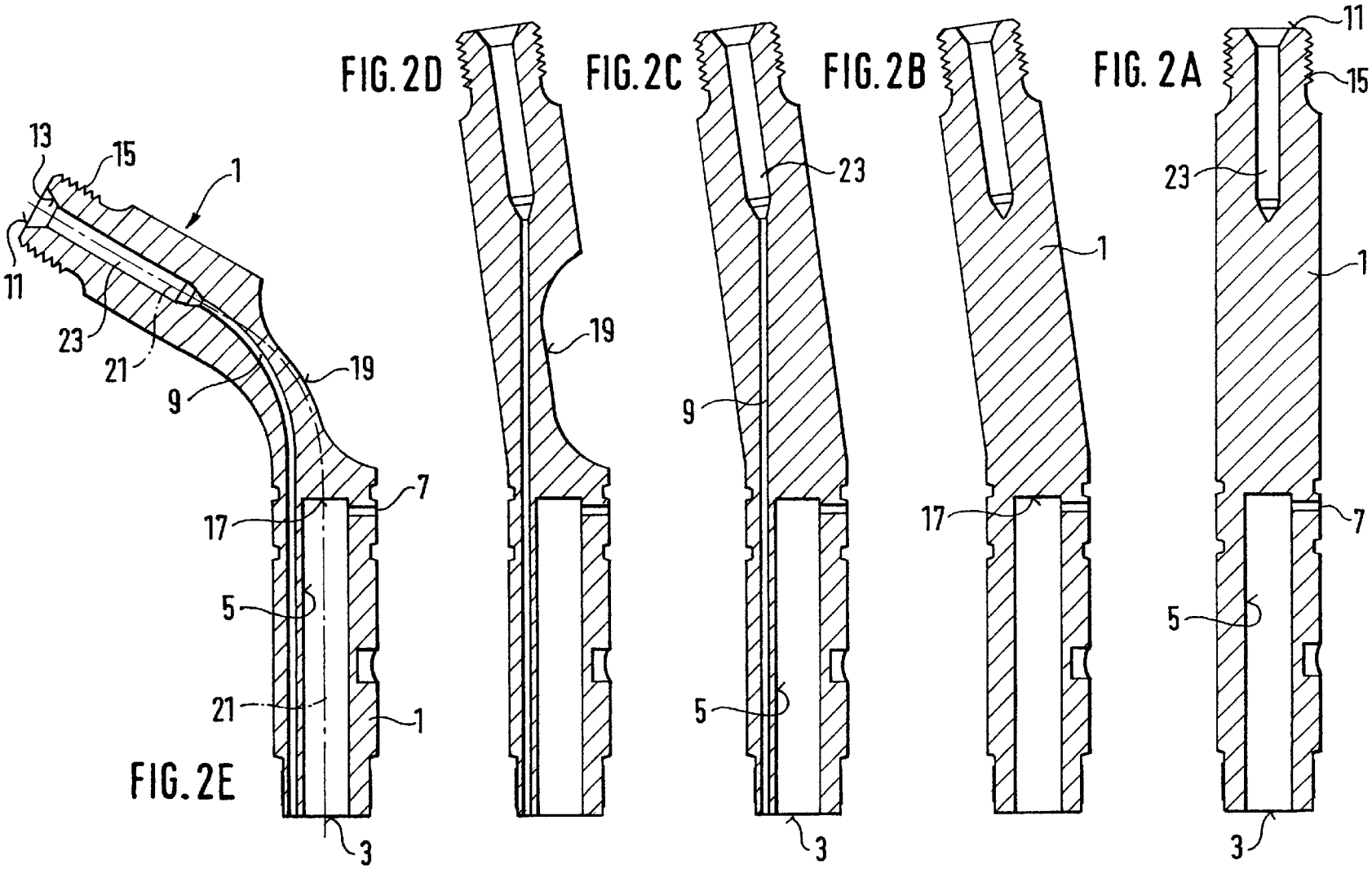
FIGS. 2A–E shows a second exemplary embodiment of the holder body in various stages of production, in which the flow conduit has two different cross sections, and a cross section of greater diameter is machined axially into the end face remote from the combustion chamber.

The second exemplary embodiment of the holder body of the invention, shown in its final form in FIG. 2E, differs from the holder body shown in FIG. 1E only in terms of the embodiment of the flow conduit 9 in the region adjoining the second end face 11. Here the flow conduit 9, in its region inclined to the axis of the central blind bore 5, has a diameter widening 23 into which a cylindrical rod filter can be inserted.

The production method according to the invention for producing the exemplary embodiment of the holder body of FIG. 2 is shown in various method stages in FIGS. 2A through 2E.

In a first method stage, analogous to FIG. 1, as shown in FIG. 2A, the central blind bore 5 and a blind bore forming the diameter widening 23 are made centrally into a holder body base body 1 from the individual end faces 3 and 11 irrespectively. The thread 15 is preferably also already machined into the holder body 1. Furthermore, it is again advantageous to make the relief bore 7, discharging into the blind bore 5, in the form of a radial bore in the holder body 1.

In a further, second method step, as shown in FIG. 2B, the holder body 1 is now bent with a slight angular offset in a region disposed above the closed end 17 of the blind bore 5.

In a further, third method step, as shown in FIG. 2C, an axial bore of the flow conduit 9 is made in the holder body 1, beginning at the first end face 3 and laterally offset from the blind bore 5; this axial bore discharges into the closed end of the diameter widening 23 and thus forms one continuous flow conduit 9.

In the fourth method step shown in FIG. 2D, the lateral recess 19 is now made by metal-cutting machining in the cylindrical jacket face of the holder body 1.

In the concluding fifth method stage shown in FIG. 2E, the holder body 1 is now bent on a bending bench in the region of the lateral recess 19, in the direction remote from this recess; large bending angles of up to or greater than 90° can be attained.

FIG. 3 shows a third exemplary embodiment of the holder body 1, in which the diameter widening 23, which receives a possible rod filter, of the flow conduit 9 is disposed obliquely to the longitudinal axis 21 of the holder body 1.

This has the advantage that there is no need to perform the slight bending of the holder body 1 shown in FIGS. 1B and 2B before the flow conduit bore 9 is made.

Figure 3C:
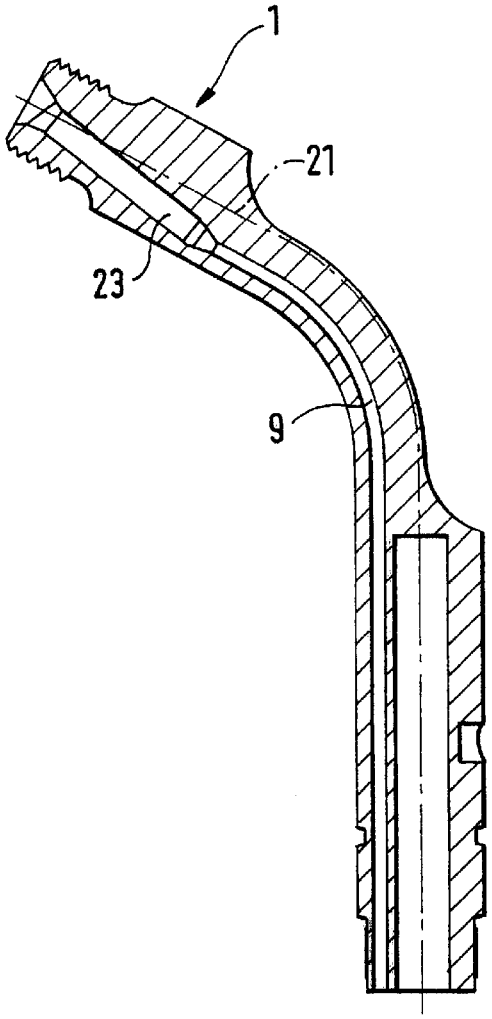
FIGS. 3A–C shows a third exemplary embodiment of the holder body in various stages of production, in which the flow conduit has two bore portions inclined toward one another, and in which the lateral recess is not machined in the holder body until after the bore geometry has been made.
Figure 3B:
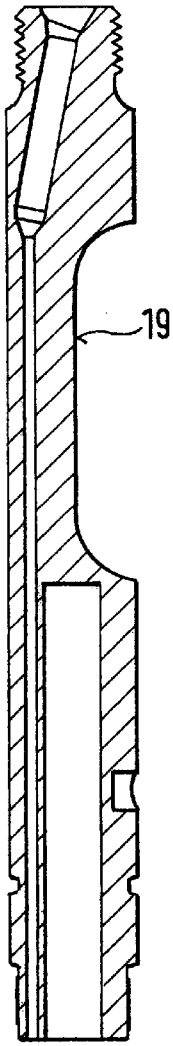
Figure 3A:
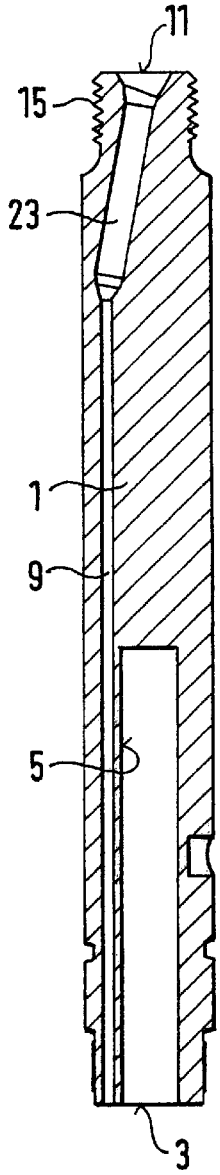

The holder body 1 of the third exemplary embodiment is shown in three essential method steps, in FIGS. 3A through 3C.

In FIG. 3A, the internal geometry of the holder body 1 with the central blind bore 5 and the flow conduit 9 is first machined; the flow conduit 9 is formed by a longitudinal bore that originates at the first end face 3 and is laterally offset from the central blind bore 5 and discharges into an oblique bore made from the second end face 11; this oblique bore, which is larger in diameter, forms the diameter widening 23 of the flow conduit 9 that receives the rod filter. The connection thread 15 is also preferably already disposed on the holder body 1 in this method stage.

In a second method step, shown in FIG. 3B, the lateral recess 19 is now machined by metal-cutting machining into the jacket face of the holder body 1.

In the third method stage, shown in FIG. 3C, the holder body 1 is now angled, preferably being bent over on a bending bench, in the direction remote from the lateral recess 19.

FIG. 4 shows a fourth exemplary embodiment of the holder body of the invention for a fuel injection valve for internal combustion engines, which differs from the third exemplary embodiment shown in FIG. 3 solely in the method of production.

Figure 4C:
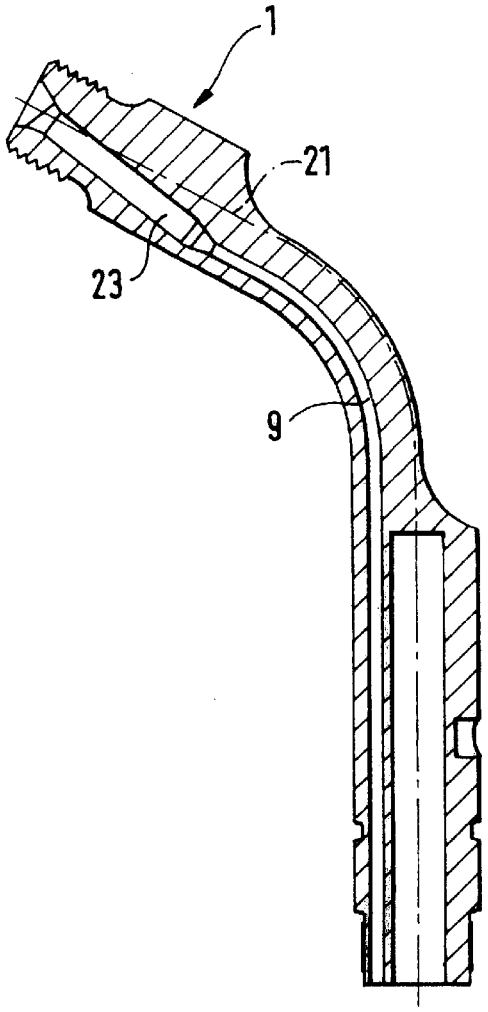
FIGS. 4A–C shows a fourth exemplary embodiment of the holder body in various stages of production analogous to FIG. 3, in which the lateral recess on the holder body has now already been machined into a holder body blank.
Figure 4B:
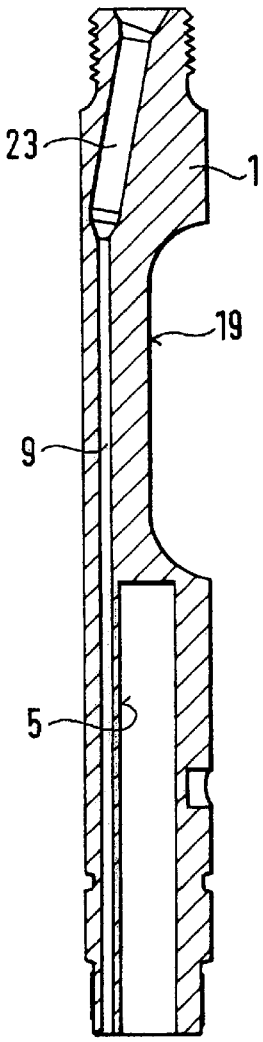
Figure 4A:
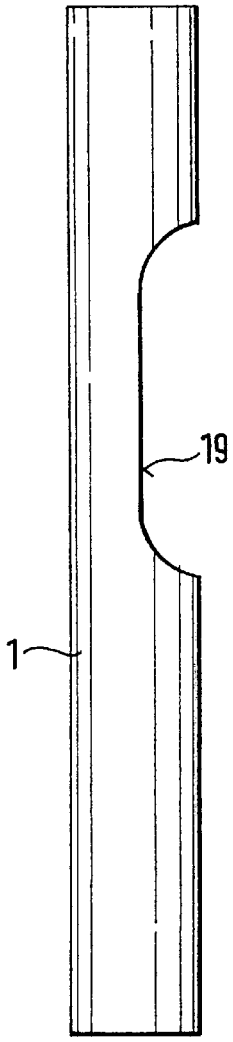

The fourth exemplary embodiment is produced in three essential method stages, shown in FIGS. 4A through 4C.

In a first method stage, shown in FIG. 4A, a holder body blank 1 is produced, in which the lateral recess 19 is already machined. This tapering of the holder body blank 1 can be done without metal-cutting machining, for instance in a forging, rolling or stamping process, but it is also possible to make the recess 19 in the holder body blank 1 by metal-cutting machining.

In a further, second method stage, shown in FIG. 4B, the internal geometry of the holder body 1 is finalized. Once again, the blind bore 5 and the flow conduit 9 are made as bores in the holder body 1, analogously to the method step shown in FIG. 3A.

In the third method step, shown in FIG. 4C, the holder body is again angled by a certain angle, counter to the direction of the lateral recess 19, up to a predetermined final value on a bending bench; the flow conduit 9 is provided in the inner region of the curve, and the recess 19 is provided in the outer region of the curve, of the angling of the holder body 1.

Thus with the four exemplary embodiments described for the holder body 1 of the invention, lateral high-pressure line connections can be made possible, without thereby generating radial fastening forces or bore intersections on the holder body 1; the holder body of the invention can be manufactured in a simple way by means of the four production methods described.

The foregoing relates to preferred exemplary embodiments of the invention, it being understood that other variants and embodiments are thereof possible within the spirit and scope of the invention, it being defined by the appended claims.

What is claimed is:

1. In a holder body for a fuel injection valve for internal combustion engines, having a substantially cylindrical basic shape and a centrally disposed axial blind bore (5), originating at a first end face (3), as well as a flow conduit (9) offset laterally from the blind bore (5), which flow conduit, entering the first end face (3), emerges from the holder body (1), axially downstream of a closed end (17) of the blind bore (5), at an incline to the axis of the blind bore (5), the improvement wherein the outlet opening of the flow conduit (9) is disposed on a second end face (11), remote from the first end face (3), of the holder body (1), and a longitudinal axis (21) of the holder body (1) in the region of the second end face (11) is angled by a predetermined angle relative to a longitudinal axis (21) of the holder body (1) in the region of the blind bore (5).

2. The holder body of claim 1, wherein the angled region of the holder body (1) is provided axially downstream of the central blind bore (5).

3. The holder body of claim 1, wherein the angling of the holder body (1) is embodied as a radius-like curvature, and a recess (19) which decreases the cross section of the holder body (1) is provided on the circumferential jacket face of the holder body (1), in a curvature region of the angling that is outward in terms of the curve.

4. The holder body of claim 3, wherein the flow conduit (9) extends in the inner wall region of the angling in terms of the curve in the holder body (1).

5. The holder body of claim 1, wherein the flow conduit (9) in the angled region has a diameter enlargement (23) that originates at the second end face (11).

6. The holder body of claim 1, wherein the flow conduit (9) merges, via a conical diameter widening (13), with the second end face (11) of the holder body (1).

7. A method for producing a holder body for a fuel injection valve for internal combustion engines as defined in claim 1, comprising the steps of:

making said blind bore (5);

bending said holder body (1) by a slight angular amount;

making said flow conduit (9), embodied as an axial through bore;

metal-cutting machining of said unilateral recess (19) on the holder body (1); and bending said holder body (1) in the direction remote from the recess (19) by a predetermined amount to produce said final angle, (FIG. 1).

8. The method defined in claim 7, wherein said holder body is bent downstream of said central blind bore to produce said final angle.

9. The method of claim 8, wherein said holder body is bent in the region of said recess (19) to provide a radius-like bend with said recess (19) on the outwardly curved region of the bend.

10. The method defined in claim 9, wherein said flow conduit (9) is formed in the inner wall region of the bend in terms of the curve in said holder body.

11. The method defined in claim 1, further comprising the steps of forming an enlarged diameter portion (23) of said flow conduit (9) that originates at the second end face of said body holder; said enlarged diameter portion terminating downstream of said blind bore.

12. The method defined in claim 1, further comprising the step of forming a conical diameter widening (13) of said flow conduit (9) at the second end face (11) of said body holder (1).

13. A method for producing a holder body for a fuel injection valve for internal combustion engines comprising the steps of:

making said blind bore (5) in said first end face (3) of the holder body (1) and making a first partial bore, forming a diameter enlargement (23) of said flow conduit (9), in said second end face (11) of said holder body (1);

bending said holder body (1) by a slight angular amount;

making said bore forming the flow conduit (9), beginning at said first end face (3), laterally offset from said blind bore (5), and discharging into said diameter enlargement (23);

metal-cutting machining of said unilateral lateral recess (19) on said holder body (1); and bending said holder body (1) in the direction remote from said recess (19) by a predetermined final value.

14. The holder body of claim 7, wherein the angled region of the holder body (1) is provided axially downstream of the central blind bore (5).

15. A method for producing a holder body for a fuel injection valve for internal combustion engines as defined in claim 1, comprising the steps of:

making said blind bore (5) in said first end face (3) of said holder body (1) and making said flow conduit (9) with a diameter enlargement (23), which extends obliquely to the axis (21) of said holder body (1) and originates at said second end face (11) and making an axial bore, beginning at said first end face (3) of the holder body (1), that discharges into said diameter enlargement;

metal-cutting machining of said unilateral lateral recess (19) on said holder body (1); and bending said holder body (1) in the direction remote from said recess (19) by a predetermined final value.

16. A method for producing a holder body for a fuel injection valve for internal combustion engines as defined in claim 1, comprising the steps of:

producing a holder body blank (1) with a unilateral lateral recess (19);

making said blind bore (5) in said first end face (3) of said holder body (1) and making said flow conduit (9) with a diameter enlargement (23), which extends obliquely to the axis (21) of said holder body (1) and which originates at said second end face (11) and making an axial bore, beginning at said first end face (3) of said holder body (1), that discharges into this diameter enlargement; and bending said holder body (1) in the direction remote from said recess (19) by a predetermined final value.

* * * * *